US006000963A

United States Patent [19]

Harting et al.

[11] Patent Number: 6,000,963

[45] Date of Patent: Dec. 14, 1999

[54] CONTACT ELEMENT WITH A CONNECTION FOR STRANDED CONDUCTORS

[75] Inventors: Dietmar Harting, Espelkamp; Klaus Olejarz, Bad Oeynhausen, both of Germany

[73] Assignee: Harting KGaA, Espelkamp, Germany

[21] Appl. No.: 09/121,609

[22] Filed: Jul. 13, 1998

[30] Foreign Application Priority Data

Jul. 16, 1997 [DE] Germany ..... 197 30 435

[51] Int. Cl.[6] ..... H01R 4/24; H01R 4/26

[52] U.S. Cl. ..... 439/416; 439/814; 439/412

[58] Field of Search ..... 439/411, 416, 439/814, 415, 417, 425, 412

[56] References Cited

U.S. PATENT DOCUMENTS

| | | | |
|---|---|---|---|
| 3,816,817 | 6/1974 | Ball et al. | 439/416 |
| 3,963,322 | 6/1976 | Gryctko | 439/814 |
| 4,738,009 | 4/1988 | Down et al. | 29/33 M |
| 5,102,347 | 4/1992 | Cote et al. | 439/412 |
| 5,634,811 | 6/1997 | Heng et al. | 439/412 |
| 5,816,844 | 10/1998 | Perera | 439/416 |

*Primary Examiner*—Khiem Nguyen
*Assistant Examiner*—Michael C. Zarroli
*Attorney, Agent, or Firm*—Dorn, McEachran, Jambor & Keating

[57] ABSTRACT

For a contact element with a connection for stranded conductors, in particular a contact element for high currents, it is proposed that the connecting end of the contact element be provided with a transverse bore in which the stranded conductor can be inserted, that the contact element be further provided with an axial threaded bore which reaches as far as the transverse bore, and that a clamping screw provided with a conical point be screwed into the threaded bore, and thus into the stranded conductor.

4 Claims, 3 Drawing Sheets

CONTACT ELEMENT WITH A CONNECTION FOR STRANDED CONDUCTORS

THE FIELD OF THE INVENTION

The invention relates to a contact element with a connection for stranded conductors, in particular a contact element for high currents, which is provided with a connecting end, wherein the connecting end has a transverse bore in which the stranded conductor can be inserted, and wherein a threaded bore is provided which is disposed perpendicularly to the transverse bore and reaches as far as the latter, and a clamping screw provided with a conical point can be screwed into the threaded bore.

The conductors are intended to be mechanically fastened to contact elements of this type, and to be electrically connected to the said contact element. In addition to secure clamping, the contact force must be maintained in a lasting manner. Under these circumstances, the conductor is to be clamped between metal faces without inadmissible damage, and to be detachable again.

Connecting terminals are known which are constructed as a pin-type terminal for guiding in/leading off the particular conductor in a manner angled by 90°, or the connection of which takes place via a screw in a threaded bore on the contact element. Under these circumstances, the conductor must be provided with a cable shoe for clamping-in purposes. The said cable shoe is squeezed or forced onto the conductor. This is possible only with special tools (pliers). In the event of on-site fitting, these require a lot of space because of their large lever arms, and are expensive. Even hydraulically actuated tools are still relatively large and heavy and have a high purchase price.

The large dimensions of the cable shoes give rise to a high space requirement for each connection. The terminal point must be accessible from outside, since the fastening means (nut or clamping screw) has to be put on and fitted, with the prescribed tightening torque, by means of the tools intended for the purpose. Subsequent protection of the terminal point against being touched when in the condition for which it is intended (namely, carrying electrical voltage) requires additional expenditure.

THE PRIOR ART

From U.S. Pat. No. 1,064,920, a contact element made of insulating material for the connection of a number of conductors that have been stripped of insulation is known, the connecting end of which is provided with a transverse bore in which the conductors stripped of insulation can be inserted. In this instance, the connecting end has a threaded bore into which there can be screwed a clamping screw which is provided with a conical point and which acts on the conductors that have been stripped of insulation.

There is additionally known, from CH 448 204, a plug body which consists of insulating material and has a plug-in end shaped as a contact sleeve. In this instance, too, a transverse bore is provided in which there can be inserted a stranded conductor which can be clamped fast, and with which contact can be made, by means of clamping screws.

There is also known, from U.S. Pat. No. 4,114,262, a cable-connector which has a base body with a transverse bore for receiving a conductor. A pin-shaped contact part, which makes contact by pressing on the conductor, can be pressed into the transverse bore.

It is commonly known, from U.S. Pat. No. 3,963,322 and DE 296 06 881 U1, to provide clamping screws, which are used for clamping, and making contact with a conductor, with a conical point which penetrates into the conductor to be connected.

SUMMARY OF THE INVENTION

The underlying object of the invention is to develop a contact element of the initially mentioned type in such a way that the said element can be manufactured in a simple manner and connection of the conductors is possible without special tools, while the space requirement of the contact elements is to be as small as possible.

This object is achieved through the fact that the contact element consists of a one-piece, cylindrical base body made of electrically conductive material, of which one end is constructed as a plug-in end and the other end as a conductor-connecting end, that the transverse bore is provided in the conductor-connecting end and is constructed as a stepped bore, the conductor lead-in end of the bore having the smaller diameter, that the threaded bore, which runs axially in the base body, starts from the plug-in end, and that the clamping screw can be manipulated through the plug-in end.

Advantageous refinements of the invention are indicated in claims 2 to 4.

The advantages achieved with the aid of the invention consist, in particular, of the fact that the stranded conductors can, without any additional aids such as cable shoes or core-end sleeves, be clamped in directly after being stripped of insulation over a specific length, without large-scale and expensive tools and with merely a hexagonal key of suitable size. At no point do the dimensions of the clamping region exceed the external dimensions of the high-current contact. Under these circumstances, the space requirement is minimal. The contact can be successfully embedded in an insulating body which requires only one opening, in each case, for the conductor connection and the plug-in region. The terminal can be manipulated from outside at any time. It is possible to check the clamping force and, if necessary, tighten up the clamping screw in the installed condition. Because of the conical point of the clamping screw, the conductor is forced against the inner wall of the transverse bore on all sides without damaging the conductor, the only region left out being that of the bore opening for the clamping screw. An intimate and gas-tight connection is produced. The conductor extraction forces that can be achieved are very high and can be compared with those of crimped connections. The connection can be undone again. Since the conductor is clamped in in a direct manner, the current-flow resistance is also low and, because of this, the self-heating of the terminal is likewise very low. As a result, the risk of malfunctioning is as good as excluded.

An exemplified embodiment of the invention is represented in the drawings and will be explained in greater detail below. In the drawings:

DESCRIPTION OF THE PREFERRED EMBODIMENT

Figure 1:
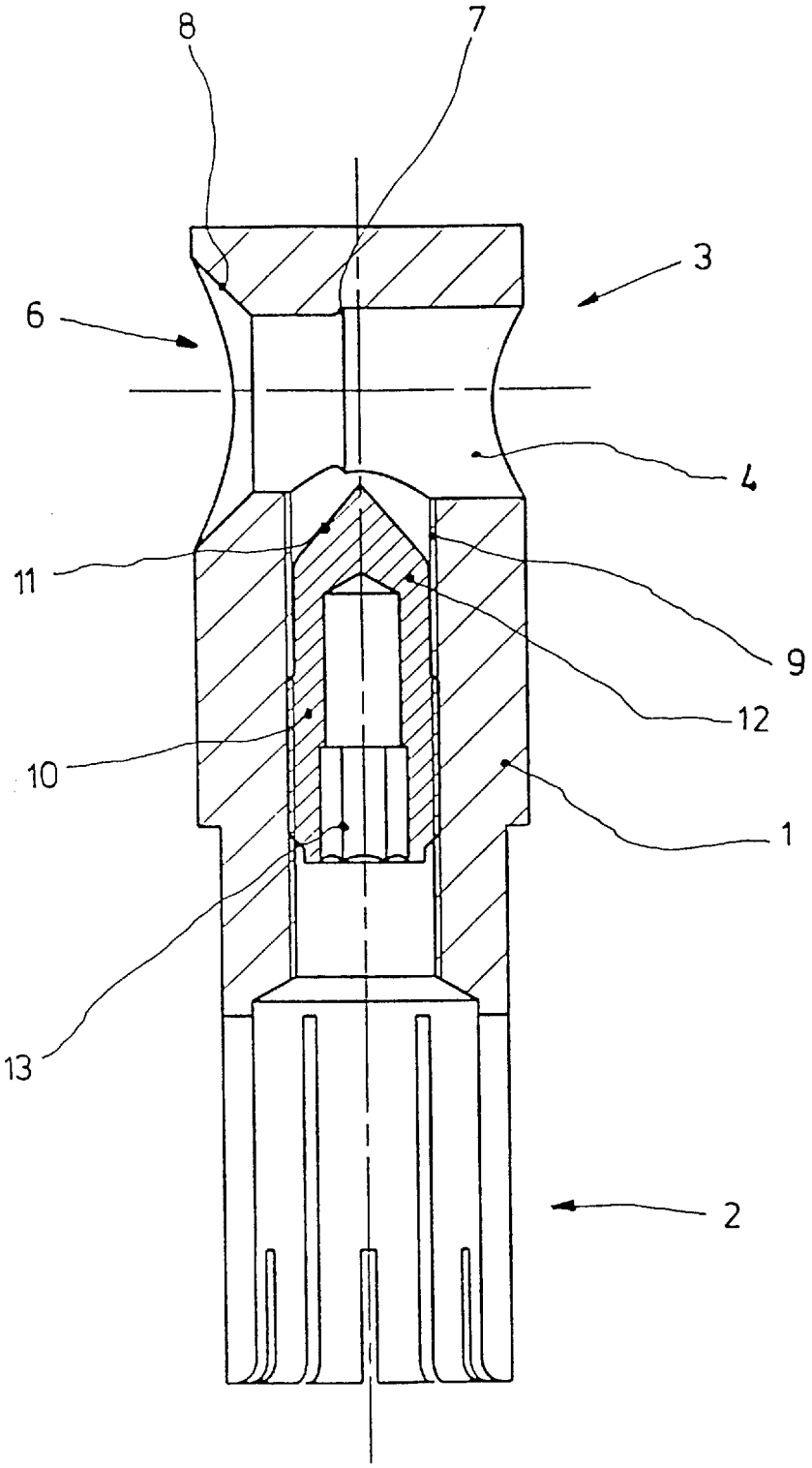
FIG. 1 shows a contact element in section.
Figure 2:
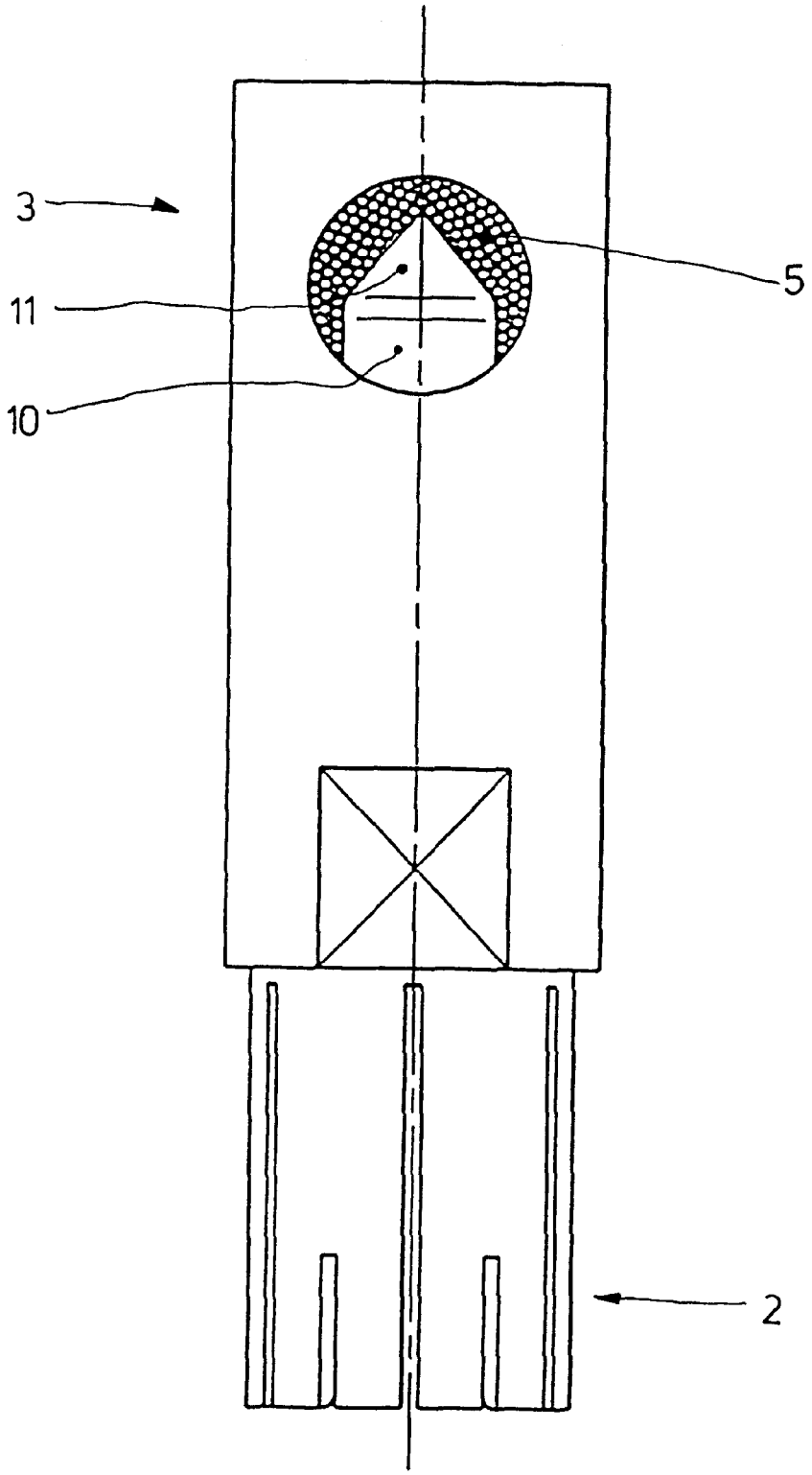
FIG. 2 shows the contact element with a conductor connected.
Figure 3:
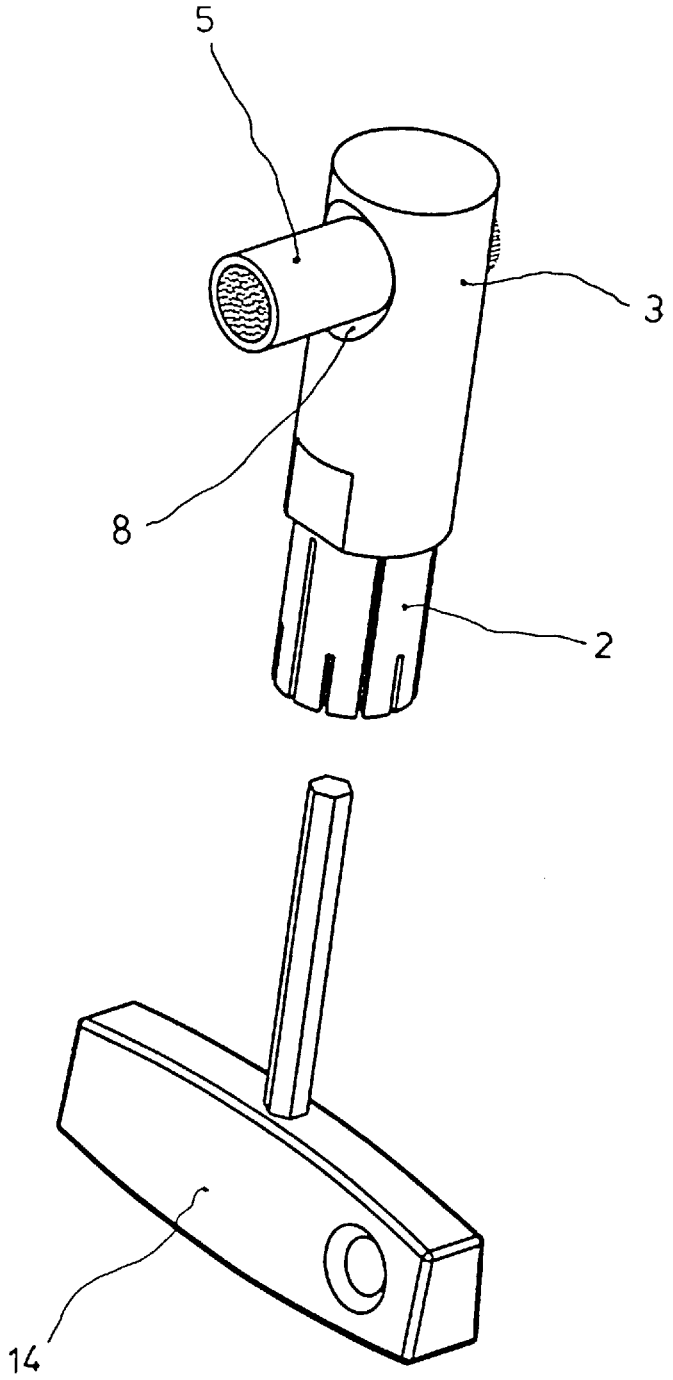
FIG. 3 shows a perspective representation of the contact element according to FIG. 2, with a manipulating tool.

FIGS. 1 to 3 represent a contact element which is constructed as a sleeve contact and essentially consists of a cylindrical base body 1 with a plug-in end 2 and a conductor-connecting end 3. Under these circumstances, the plug-in end, which is constructed as a contact sleeve in this case, may optionally also be constructed as a contact pin.

The conductor-connecting end is provided with a transverse bore 4 which passes through the said end. The stranded conductor 5 (see FIGS. 2 and 3) to be connected is inserted in the said bore. Under these circumstances, the transverse bore is designed as a stepped bore, the said bore having a smaller diameter at the conductor lead-in end 6.

As a result, a shoulder 7, the effect of which is described later on, is constructed inside the transverse bore. Finally, the transverse bore is further provided, at the conductor lead-in end, with a chamfer 8 which facilitates the introduction of a conductor.

Starting from the plug-in end 2 of the contact element, the base body 1 is provided with an axial, central threaded bore 9 which reaches as far as the transverse bore and ends there. A clamping screw 10 is screwed into the said threaded bore. The clamping screw is provided with a conical point 11 which is forced into the stranded conductor introduced into the transverse bore. Under these circumstances, the front end of the clamping screw is preferably provided with a shouldered, non-threaded shaft 12 in order to avoid damage to the strands of the conductor by sharp-edged thread courses when the clamping screw is screwed in.

The conical point and the transverse bore are coordinated with one another in such a way that at least two "neighboring" conductor cross-sections (for example 50 $mm^2$ and 70 $mm^2$ or 95 $mm^2$ and 120 $mm^2$) can be clamped in. For the purpose of manipulating the clamping screw, the latter is preferably provided with a hexagonal recess 13 and can thus be screwed in by means of a manipulating tool 14.

For the purpose of connecting a stranded conductor 5 to the contact element, the said conductor is first stripped of insulation at its front end and the said end is inserted in the transverse bore.

Naturally, a number of small conductors may also be clamped in at the same time, with the proviso that the total cross-section must lie within the intended clamping range. In the initial state, the point of the clamping screw 10 must not yet project into the transverse bore 4. The stranded conductor 5 which has been stripped of insulation is inserted in the transverse bore as far as the opposite end thereof. The clamping screw can be tightened with the aid of an ordinary commercial hexagonal screwdriver, the end of which can be pushed through the longitudinal bore in the contact element as far as the hexagonal recess in the clamping screw. Under these circumstances, the conical point 11 penetrates into the stranded conductor 5 and distributes the latter uniformly over both sides of the narrowing cross-section of the bore. The strand is forced against the wall in the region of the shoulder 7. Since the strand encounters a somewhat larger bore after the shoulder 7, it is opened out to a somewhat greater extent at that point. The effect of this measure is that pulling-out of the conductor is made more difficult. For doing so, major extracting forces are required, which are comparable to those for a crimped connection. If fine threads are used, the security from vibration is increased at the same time. Since contact with the stranded conductor is made all round, both on its outer periphery and also in its internal region, by the clamping cone, a low current-flow resistance at the connecting point is achieved. Consequently, only low self-heating occurs at the said connecting point.

We claim:

1. Contact element with a connection for stranded conductors, in particular a contact element for high currents, which is provided with a connecting end (3), the connecting end having a transverse bore (4) in which the stranded conductor (5) can be inserted, a threaded bore (9) is provided which is disposed perpendicularly to the transverse bore and reaches as far as the latter, a clamping screw (10) is provided with a conical point (11) which can be screwed into the threaded bore, characterized in that the contact element consists of a one-piece, cylindrical base body (1) made of electrically conductive material, of which one end is constructed as a plug-in end (2) and the other end as a connecting end (3), that the transverse bore (4) is provided in the connecting end (3) and is constructed as a stepped bore, the conductor lead-in end (6) of the bore having the smaller diameter, that the threaded bore (9), which runs axially in the base body (1), starts from the plug-in end (2), and that the clamping screw (10) can be manipulated through the plug-in end.

2. Contact element according to claim 1, characterized in that the transverse bore (4) is provided, at the conductor lead-in end (6), with a chamfer (8).

3. Contact element according to claim 1, characterized in that the clamping screw (10) is provided with a hexagonal recess (13).

4. Contact element according to claim 1, characterized in that the clamping screw (10) has, at its front end, a shouldered, non-threaded shaft (12) which merges into the conical point.

* * * * *